US006224340B1

(12) United States Patent
Lessig, III

(10) Patent No.: US 6,224,340 B1
(45) Date of Patent: May 1, 2001

(54) FAN RETENTION SYSTEM

(75) Inventor: William R. Lessig, III, Hunt Valley, MD (US)

(73) Assignee: Black & Decker, Inc., Newark, DE (US)

( * ) Notice: Subject to any disclaimer, the term of this patent is extended or adjusted under 35 U.S.C. 154(b) by 0 days.

(21) Appl. No.: 09/253,215

(22) Filed: Feb. 19, 1999

Related U.S. Application Data

(60) Provisional application No. 60/075,310, filed on Feb. 20, 1998.

(51) Int. Cl.[7] ..... F04D 29/20

(52) U.S. Cl. ..... 416/244 R; 416/62; 416/604 R; 411/188; 411/429; 411/908

(58) Field of Search ..... 416/244 R, 244 A, 416/245 R, 204 R, 146 R, 62; 415/216.1; 411/185, 186, 187, 188, 189, 429, 908

(56) References Cited

U.S. PATENT DOCUMENTS

| | | | |
|---|---|---|---|
| 633,376 | | 9/1899 | Davies . |
| 1,066,761 | | 7/1913 | Semon . |
| 1,254,725 | | 1/1918 | Portee . |
| 1,622,581 | | 3/1927 | Gunkel . |
| 1,651,188 | | 11/1927 | Cole . |
| 2,322,776 | | 6/1943 | Poupitch . |
| 2,424,208 | | 7/1947 | Poupitch . |
| 3,329,190 | | 7/1967 | Oldenkott . |
| 3,332,464 | | 7/1967 | Castel . |
| 3,761,867 | | 9/1973 | Churla . |
| 3,771,927 | * | 11/1973 | Schiller ..... 415/131 |
| 3,881,392 | | 5/1975 | Curtis . |
| 3,895,663 | | 7/1975 | Bashline et al. . |
| 4,134,438 | | 1/1979 | Frieberg et al. . |
| 4,147,470 | * | 4/1979 | Brooks et al. ..... 416/95 |
| 4,220,188 | * | 9/1980 | McMurray ..... 151/37 |
| 4,315,343 | | 2/1982 | Neroda et al. . |
| 4,657,459 | | 4/1987 | Landt . |
| 4,788,740 | | 12/1988 | Sovis et al. . |
| 4,842,463 | | 6/1989 | Landt . |
| 4,941,805 | * | 7/1990 | Matthews ..... 416/204 R |
| 5,131,690 | * | 7/1992 | Mano ..... 411/149 |
| 5,711,048 | * | 1/1998 | Pink et al. ..... 15/347 |
| 5,871,335 | * | 2/1999 | Bartlett ..... 416/244 R |

FOREIGN PATENT DOCUMENTS

| | | |
|---|---|---|
| 7501390 | 10/1975 | (DE) . |
| 2942629 | 10/1982 | (DE) . |
| 3022391 | 8/1988 | (DE) . |
| 0043538 | 10/1982 | (EP) . |

* cited by examiner

*Primary Examiner*—Edward K. Look
*Assistant Examiner*—Liam McDowell
(74) *Attorney, Agent, or Firm*—Ajay Gambhir

(57) ABSTRACT

A fan retention system for a blower/vacuum securely retains the fan and creates an insulating barrier to prevent the operator from touching the functionally insulated armature shaft. A nut having interlocking ramps for interlocking with interconnecting portions on an abutting fan surface is provided. The interconnecting portions of the fan may be either ramps or recesses. Furthermore, the nut has a closed end for insulating the armature shaft from the operator.

26 Claims, 5 Drawing Sheets

FAN RETENTION SYSTEM

This application claims benefit to U.S. provisional application Ser. No. 60/075,310, filed Feb. 20, 1998.

BACKGROUND OF THE INVENTION

1. Field of the Invention

The invention relates to an improved system for securing a fan to a drive shaft. In particular, the system is useful for securing fans in blower/vacuum systems used for vacuuming or blowing debris, such as leaves and grass clippings, from a lawn or other ground surface.

2. Background of Related Art

Although applicable in a variety of environments, the securing system of the invention is especially useful for securing a fan to an armature shaft in a blower or blower/vacuum. Various systems are known in the art for securing a fan to a drive shaft within the blower/vacuum environment. In such environments, a fan is mounted to a drive shaft for rotation. In the vacuum configuration, spaced fan blades allow a range of debris to pass through them to an outlet and generally to a collection apparatus. In the blower configuration, a discharge tube may be connected to the outlet to discharge exhaust air.

A known system is shown in FIG. 2. A centrally aligned mounting boss includes interior bores and which receive the end of a drive shaft to form an interference fit. An additional known configuration involves providing a standard nut at the end of the armature shaft. Difficulties encountered with these and other known configurations include the awkward shape of the fan creating balancing difficulties within the mold, slipping of the armature within the interior fan bores, and loosening of the standard nut. Additionally, the use of a standard nut requires relatively costly insulation between the armature and the armature shaft in order to double insulate the touchable parts.

Plastic parts tend to creep over time and as a result of moisture and temperature variations. Accordingly, prior art systems, which involve tightening an ordinary plastic nut are often inadequate because the nut tends to loosen.

SUMMARY OF THE INVENTION

Objects of the invention include the provision of a fan securing system that provides a securely mounted fan, an insulating barrier that prevents the operator from touching the armature shaft, and a fan shape that balances well within a mold.

These and other objects are achieved by providing a fan securing system for securing a fan onto an armature shaft. The securing system comprises a nut having a central aperture through a first surface. The first surface includes a series of ramps spaced around the central aperture. Internally molded threads within the central aperture engage the armature shaft. A first fan surface portion comprises a central aperture through which the armature shaft passes and a series of interruptions configured to interlock with the series of ramps on the nut. The interruptions may comprise recesses or mating ramps.

The objects are further achieved by providing a blower/vacuum for selective operation in blower mode and suction mode, the blower/vacuum comprising an armature shaft and a fan mounted on the armature shaft through a central aperture. The fan comprises a first fan surface portion having a series of interruptions. A nut having a central aperture through a first surface is provided. The aperture has internally molded threads that engage the armature shaft. A series of ramps is spaced around the central aperture. The ramps are configured to interlock with interruptions on the first fan surface portion.

BRIEF DESCRIPTION OF DRAWINGS

The foregoing aspects and specific embodiments of the invention are disclosed in the detailed description in conjunction with the accompanying drawings, in which:

FIG. 5(*b*) is a sectional view of an embodiment of the insulating nut;

FIG. 5(*c*) is a detail of FIG. 5(*b*);

FIG. 5(*d*) is a bottom plan view of the insulating nut;

FIG. 6(*b*) is a bottom plan view of the fan of FIG. 6 (*a*);

FIG. 6(*c*) is a detail of the bottom plan view of FIG. 6(*b*);

FIG. 7(*b*) is a detail of FIG. 7(*a*);

FIG. 8(*b*) is a detail of FIG. 8(*a*);

FIG. 9(*b*) is a sectional view of the fan and nut of an embodiment of the invention.

DETAILED DESCRIPTION OF PREFERRED EMBODIMENTS

Figure 2:
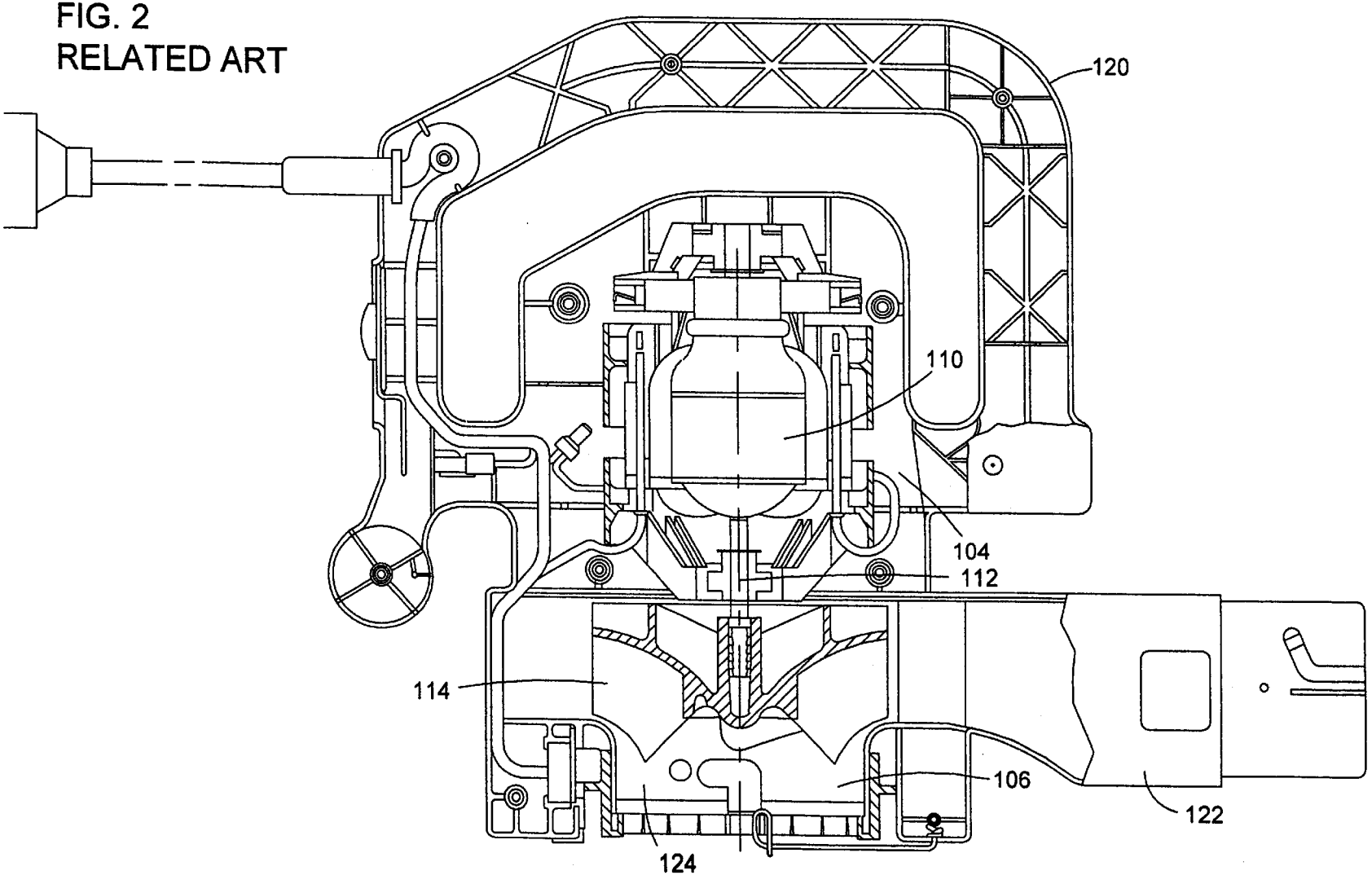
FIG. 2 RELATED ART
FIG. 2 is a sectional view of a typical blower/vacuum apparatus.

FIG. 2 illustrates a typical blower/vac configuration. The configuration comprises motor unit 104 and vacuum volute 106. The motor unit 104 comprises motor 110 that drives a shaft 112. A fan 114 is mounted on the shaft so that it may be driven by motor 110. The motor unit 104 further includes handle arrangement 120.

Vacuum volute 106 comprises a suction duct 124 and expelling duct 122. The vacuum volute 106 is shaped to accommodate fan 114. In use, air is drawn in through suction duct 124 and expelled through expelling duct 122.

A porous collecting bag (not shown) may be releasably attachable to the end of expelling duct 122 distant from fan 114. Vacuum volute 106 is releasably attachable to motor unit 104. An extension tube (not shown) may be releasably attachable to the end of the suction duct 124 remote from fan 114. In this particular prior art arrangement the fan is pressed onto the shaft.

Figure 1:
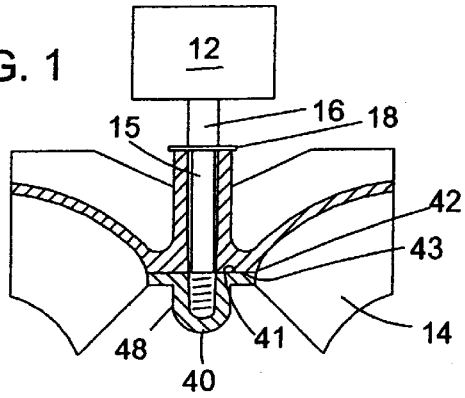
FIG. 1 is a sectional view of an embodiment of the fan securing system of the invention in its assembled form.
Figure 5D:
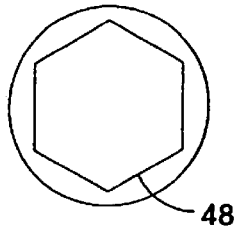
FIG. 5(*a*) is a top plan view of the insulating nut.

The present invention relates to an improved assembly that secures the fan to the armature shaft. FIG. 1 is a sectional view of an embodiment of the fan securing system of the invention in its assembled form. Armature shaft 16 extends outwardly from motor 12 and through a central bore 15 in fan 14. The central bore 15 may be a double "D" shaped bore, as is more clearly shown in FIG. 6(*b*). A washer 18 is provided at the juncture of fan 14 and armature shaft 16. Insulated nut 40 secures fan 14 to armature shaft 16. Surface 41 of insulating nut 40 abuts surface 43 of fan 14 to create interface 42, which is described in more detail with reference to FIGS. 5–8.

Figure 3:
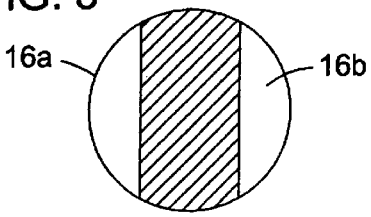
FIG. 3 is a cross-sectional view of the armature shaft of an embodiment of the invention.
Figure 4:
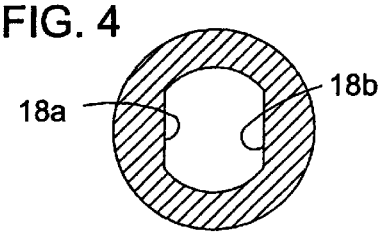
FIG. 4 is a cross-sectional view of the washer of an embodiment of the invention.
Figure 5A:
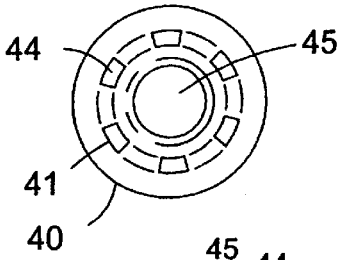
Figure 5B:
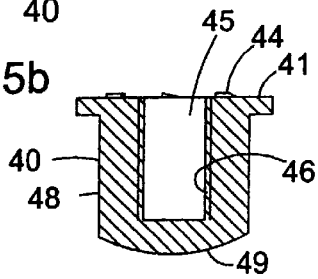
Figure 5C:
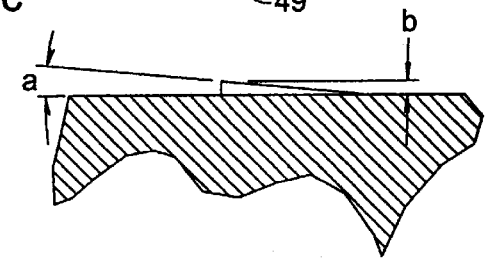

As shown in FIG. 4, washer 18 is provided with flats 18*a* and 18*b* to provide a thrust surface that gives axial location to the fan. FIG. 3 illustrates a corresponding part of armature shaft 16, having flats 16*a* and 16*b*. These flats are located on the portion of the armature where it passes through the fan in order to locate the fan rotationally.

Figure 9A:
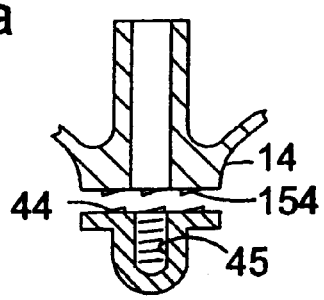
FIG. 9(*a*) is a sectional view of the fan and nut of an embodiment of the invention.
Figure 9B:
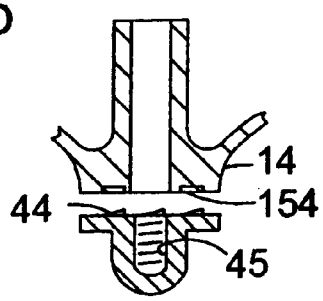
Figure 10:
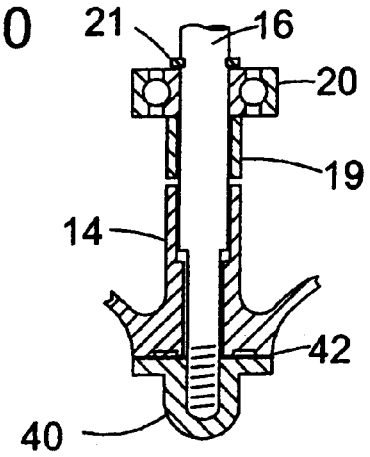
FIG. 10 is a sectional view of an alternative embodiment.

FIG. 10 illustrates an additional preferred embodiment of the invention in which washer 18 is replaced with a combination of spacer 19, ball bearing 20 and retaining ring 21. When washer 18 is used, the shaft 16 requires a flattened portion through the length of the fan hub. The alternative arrangement shown in FIG. 10 eliminates this necessity. The fan and nut configurations shown in FIGS. 3 through 9 can be utilized with both the arrangement shown in FIG. 1 and the arrangement shown in FIG. 10.

FIGS. 5(*a*)–5(*d*) show the nut of the invention. The nut is preferably made of plastic and serves the function of insulating the armature shaft. FIG. 5(*a*) is a top plan view of the insulating nut. In this instance "top" refers to the top of the nut as viewed from its position in FIG. 2. The nut includes a plurality of interlocking ramps 44 spaced around central bore 45 of the nut. In the embodiment illustrated in FIG. 5(*a*), six interlocking ramps are evenly spaced within the perimeter of nut 40.

FIG. 5(*b*) is a sectional view that shows internal threads 46 within bore hole 45 of the nut. Bottom surface 48 of the nut insulates the armature shaft. Interlocking ramps 44 are clearly shown in FIG. 5(*c*). In an embodiment of the invention, angle 'a' of the interlocking ramps is between about 2 and 15 degrees. In a preferred embodiment, the angle a is about 8 degrees. Distance b is the distance of the furthest point of ramps 44 from nut surface 41.

While the periphery of surface 41 may be circular in shape, the surface portion 48 extending downwardly from portion 41 may include multiple flat surfaces. As shown in the bottom plan view of FIG. 5(*d*), surface 48 may be a six sided polygonal shape.

Figure 6A:
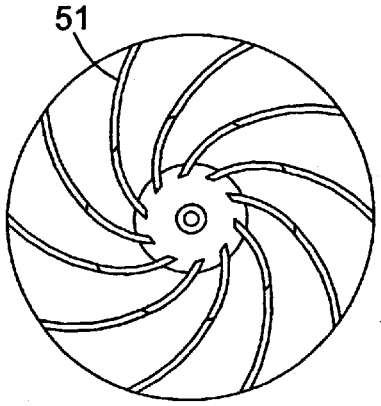
FIG. 6(*a*) is a top plan view of a fan of the invention.
Figure 6B:
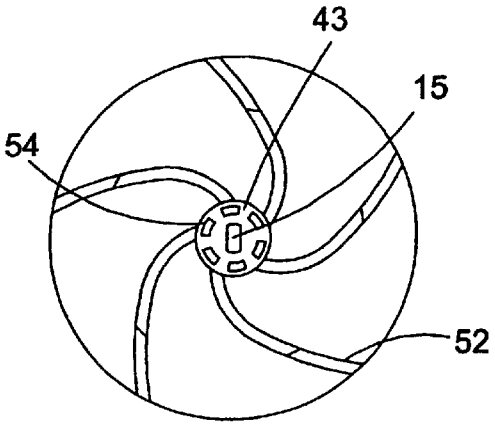
Figure 6C:
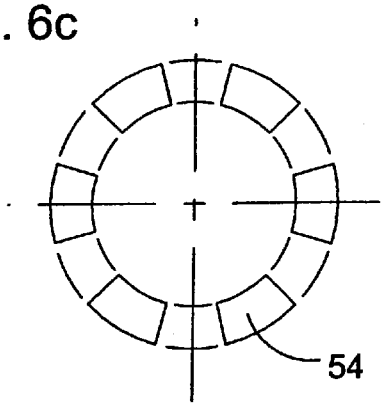

FIGS. 6(*a*)–6(*c*) illustrate an embodiment of the fan of the invention. FIG. 6(*a*) is a top plan view of fan 14 showing ten equally spaced cooling blades 51. FIG. 6(*b*) is a bottom plan view of fan 14 showing five equally spaced mulching blades 52. Fan interface 43 includes central bore 15 and locking portions 54. Locking portions 54 are shown in more detail in FIG. 6(*c*). In one preferred embodiment the locking portions are equally spaced at approximately twenty-eight degrees apart on fan interface 43.

Figure 7A:
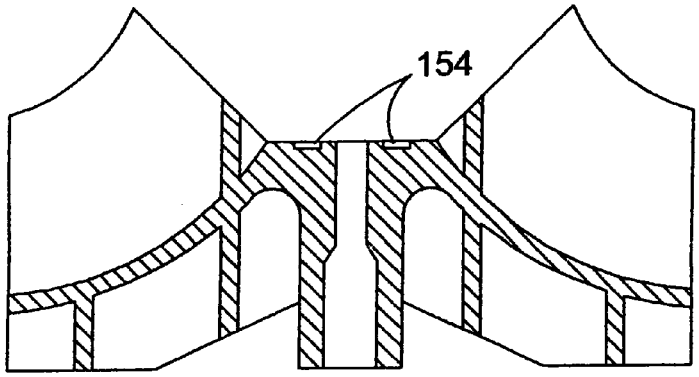
FIG. 7(*a*) is a sectional view of an embodiment of the fan.
Figure 7B:
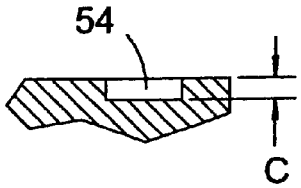

FIGS. 7(*a*) and 7(*b*) further illustrate a preferred fan configuration. Interlocking portions 54 are recesses having a depth c as shown in FIG. 7(*b*) that is approximately equal to the height b of the nut interlocking portions as shown in FIG. 5(*c*). This configuration enables the nut to interlock with the fan to create a secure connection. FIG. 7(*b*) is a sectional view illustrating interlocking portions 54 along surface 43 of fan 14.

Figure 8A:
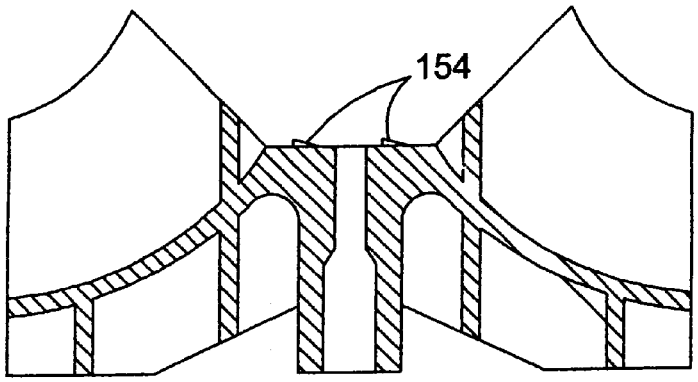
FIG. 8(*a*) is a sectional view of an embodiment of the fan.
Figure 8B:
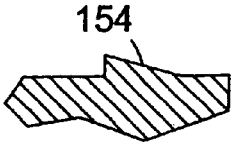

An alternative preferred configuration is shown in FIGS. 8(*a*) and 8(*b*). FIGS. 8(*a*) and 8(*b*) show interlocking portions 54 of the fan as ramps rather than recesses.

FIG. 9(*a*) is a sectional view showing the interlocking configuration of FIGS. 8(*a*) and 8(*b*). Interlocking ramps 44 of nut 40 securely connect with interconnecting portions 154 of fan 14. Interconnecting portions 154 are in the form of interlocking ramps.

FIG. 9(*b*) is a sectional view showing the interlocking configuration of FIGS. 7(*a*) and 7(*b*). Interlocking ramps 44 of nut 40 securely connect with interconnecting portions 54 of fan 14. Interconnecting portions 54 are in the form of recesses.

It should be understood that the foregoing description is merely illustrative and is not intended to be limiting. Various alternatives and modifications may be apparent to those skilled in the art. Accordingly, the invention is intended to encompass all such alternatives, modification, and variations which fall within the scope of the appended claims.

What is claimed is:

1. A fan securing system for securing a fan onto an armature shaft comprising:

a nut comprising, a central aperture through a first surface, the central aperture having internally molded threads that engage the armature shaft, and a series of ramps spaced around the central aperture; and a first fan surface portion comprising, a central aperture through which the armature shaft passes, and a series of interruptions configured to interlock with the series of ramps on the nut.

2. The fan securing system of claim 1, wherein the series of interruptions comprises recesses shaped to interconnect with the series of ramps on the nut.

3. The fan securing system of claim 1, wherein the series of interruptions comprises interlocking ramps that interlock with the series of ramps on the nut.

4. The fan securing system of claim 1, wherein the nut has a second closed surface opposite the first surface for completely covering and insulating an end of the armature shaft.

5. The fan securing system of claim 4, wherein an outer circumference of the nut between the first surface and the second closed surface comprises at least two flat portions for facilitating tightening of the nut.

6. The fan securing system of claim 1 wherein, a washer circumscribes the armature and abuts a second fan surface.

7. The fan securing system of claim 6, wherein the washer includes at least one flat portion that corresponds to a flat portion of the armature shaft.

8. The fan securing system of claim 1, wherein an angle of inclination of each ramp in the series of ramps is between approximately 2 and 30 degrees.

9. The fan securing system of claim 1, wherein an angle of inclination of each ramp in the series of ramps is between approximately 5 and 15 degrees.

10. The fan securing system of claim 1, wherein an angle of inclination of each ramp in the series of ramps is between approximately 7 and 9 degrees.

11. A blower/vacuum for selective operation in blower mode and suction mode, the blower/vacuum comprising:

an armature shaft;

a fan mounted on the armature shaft through a central aperture, the fan comprising a first fan surface portion having a series of interruptions; and a nut comprising a central aperture through a first surface, the central aperture having internally molded threads that engage the armature shaft, and a series of ramps spaced around the central aperture configured to interlock with interruptions on the first fan surface portion.

12. The blower/vacuum of claim 11, wherein the series of interruptions comprises recesses shaped to interconnect with the series of ramps on the nut.

13. The blower/vacuum of claim 11, wherein the series of interruptions comprises interlocking ramps that interlock with the series of ramps on the nut.

14. The blower/vacuum of claim 11, wherein the nut has a second closed surface opposite the first surface for completely covering and insulating an end of the armature shaft.

15. The blower/vacuum of claim 14, wherein an outer circumference of the nut between the first surface and the second closed surface comprises at least two flat portions for facilitating tightening of the nut.

16. The blower/vacuum of claim 11, wherein a washer circumscribes the armature and abuts a second fan surface.

17. The blower/vacuum of claim 16, wherein the washer includes at least one flat portion that corresponds to a flat portion of the armature shaft.

18. The blower/vacuum of claim 11, wherein an angle of inclination of each ramp in the series of ramps is between approximately 2 and 30 degrees.

19. The blower/vacuum of claim 11, wherein an angle of inclination of each ramp in the series of ramps is between approximately 5 and 15 degrees.

20. The blower/vacuum of claim 11, wherein an angle of inclination of each ramp in the series of ramps is between approximately 7 and 9 degrees.

21. A fan securing system for securing a fan onto an armature shaft comprising:

a plastic nut comprising, a central aperture through a first surface, the central aperture having internally molded threads that engage the aperture shaft, and a series of ramps spaced around the central aperture; and a first fan surface portion comprising, a central aperture through which the armature shaft passes, and a series of interruptions configured to interlock with the series of ramps on the nut.

22. A blower/vacuum for selective operation in blower mode and suction mode, the blower/vacuum comprising:

an armature shaft;

a fan mounted on the armature shaft through a central aperture, the fan comprising a first fan surface portion having a series of interruptions; and a plastic nut comprising a central aperture through a first surface, the central aperture having internally molded threads that engage the armature shaft, and a series of ramps spaced around the central aperture configured to interlock with interruptions on the first fan surface portion.

23. A fan securing system for securing a fan onto an armature shaft comprising;

a nut comprising, a central aperture through a first surface, the central aperture having internally molded threads that engage the armature shaft, and a series of ramps having a first profile, the series of ramps spaced around the central aperture; and a first fan surface portion comprising, a central aperture through which the armature shaft passes, and a series of interruptions defining recesses configured to interlock with the series of ramps on the nut, the series of interruptions having a second profile different an the first profile.

24. A blower/vacuum for selective operation in blower mode and suction mode, the blower/vacuum comprising:

armature shaft;

a fan mounted on the armature shaft through a central aperture, the fan comprising a first fan surface portion having a series of interruptions defining recesses, the series of ramps having a first profile; and a nut comprising a central aperture through a first surface, the central aperture having internally molded threads that engage the armature shaft, and a series of ramps spaced around the central aperture configured to interlock with interruptions on the first fan surface portion, the series of ramps having a second profile different than the first profile.

25. The fan securing system of claim 23, wherein the second profile has a uniform thickness.

26. The blower/vacuum of claim 24, wherein the second profile has a uniform thickness.

* * * * *